US008359707B1

(12) United States Patent
Prezner

(10) Patent No.: US 8,359,707 B1
(45) Date of Patent: Jan. 29, 2013

(54) ROD BRACKETS AND RELATED SYSTEMS AND METHODS

(75) Inventor: Ronald Prezner, Valhalla, NY (US)

(73) Assignee: Decorative Hardware Studio Inc., Chappaqua, NY (US)

( * ) Notice: Subject to any disclaimer, the term of this patent is extended or adjusted under 35 U.S.C. 154(b) by 0 days.

(21) Appl. No.: 13/413,266

(22) Filed: Mar. 6, 2012

(51) Int. Cl.
*A47G 27/06* (2006.01)

(52) U.S. Cl. ..... 16/12; 16/10; 16/15; 248/500; 248/505

(58) Field of Classification Search ..... 16/12, 10, 16/11; 24/17 AB, 24, 492; 248/74.4, 74.1, 248/230.5, 316.6, 511, 518
See application file for complete search history.

(56) References Cited

U.S. PATENT DOCUMENTS

| | | | | | |
|---|---|---|---|---|---|
| 869,492 | A | * | 10/1907 | Joyner | 16/15 |
| 1,385,311 | A | * | 7/1921 | Phillips | 16/10 |
| 1,624,393 | A | * | 4/1927 | Clokey | 178/63 R |
| 2,722,450 | A | * | 11/1955 | Nelson | 294/90 |
| 2,864,644 | A | * | 12/1958 | Marryatt | 294/81.51 |
| 3,575,458 | A | * | 4/1971 | Crook et al. | 294/82.2 |
| D391,472 | S | | 3/1998 | Smiley et al. | |
| 5,960,516 | A | * | 10/1999 | Zoroufy et al. | 16/12 |
| 6,338,179 | B1 | | 1/2002 | Blackstone | |
| D481,467 | S | | 10/2003 | Brice | |
| D487,393 | S | | 3/2004 | Blackstone | |
| 6,807,788 | B1 | | 10/2004 | Terry | |
| 6,839,936 | B2 | | 1/2005 | Kaufman | |
| D507,478 | S | | 7/2005 | Blackstone | |
| 7,080,426 | B2 | | 7/2006 | Roychowdhury | |
| D533,766 | S | | 12/2006 | Roychowdhury | |
| D533,767 | S | | 12/2006 | Roychowdhury | |
| 7,461,431 | B2 | | 12/2008 | Zoroufy | |

* cited by examiner

*Primary Examiner* — Amy J. Sterling
(74) *Attorney, Agent, or Firm* — Day Pitney LLP; Brian R. Pollack, Esq.

(57) ABSTRACT

The disclosure includes a variety of rod brackets. An exemplary rod bracket includes a base portion adapted and configured to be mounted to a surface and a top portion adapted and configured to mate with the base portion. The top portion and base portion cooperate to define a recess for holding at least a portion of a rod. The bracket further includes a retainer adapted and configured to hold the top portion and the base portion together, wherein the retainer is displaceable, such as slidably displaceable, from a first position wherein the retainer prevents the base portion and top portion from separating, to a second position wherein the base portion and top portion can be separated.

2 Claims, 3 Drawing Sheets

ROD BRACKETS AND RELATED SYSTEMS AND METHODS

BACKGROUND

1. Field of the Disclosure

The present disclosure relates to methods, systems and articles for retaining articles. Particularly, the present disclosure is directed to rod brackets that can be used in a variety of settings such as retaining stair rods.

2. Description of Related Art

Carpet runners or other floor coverings are affixed to stairs using stair rod sets. Many stair rod sets sold today are used as a decorative accent to the stairs and carpet runners. The stair rod set can serve a useful function in preventing slippage of the carpet runner on the stairs of a staircase as well as a decorative function. A staircase typically has a plurality of steps. Each step has a riser and a tread. The stair rod set typically includes a pair of brackets with each bracket fastened to a step of a staircase. The brackets are spaced from the edges of the carpet runner and fastened at opposite sides of the step. Stair brackets frequently have a top portion and a bottom portion. Often, the bottom portion is fastened to the riser and the tread of the step of the staircase. A rod extends over the carpet runner and is held between and by the pair of brackets. A pair of finials may be used in conjunction with the stair rod and pair of brackets with one finial attached to each bracket. In some devices, the stair rod extends through the bracket. In these instances, the bracket is often referred to as a "stair eye" or "open eye-type bracket" because the bracket has a hole or eye therethrough for accepting the stair rod. The present disclosure improves upon the state of the art as set forth herein.

SUMMARY OF THE DISCLOSURE

Advantages of the present disclosure will be set forth in and become apparent from the description that follows. Additional advantages of the disclosure will be realized and attained by the methods and systems particularly pointed out in the written description and claims hereof, as well as from the appended drawings.

To achieve these and other advantages and in accordance with the purpose of the disclosure, as embodied herein, the disclosure includes a variety of rod brackets. An exemplary rod bracket includes a base portion adapted and configured to be mounted to a surface and a top portion adapted and configured to mate with the base portion. The top portion and base portion cooperate to define a recess for holding at least a portion of a rod. The bracket further includes a retainer adapted and configured to hold the top portion and the base portion together, wherein the retainer is displaceable, such as slidably displaceable, from a first position wherein the retainer prevents the base portion and top portion from separating, to a second position wherein the base portion and top portion can be separated.

In accordance with one embodiment, the retainer is adapted and configured to fall into the first position under the action of gravity when the rod bracket is mounted to a surface. If desired, the base portion and top portion can be connected by a hinge, wherein the base portion and top portion can be selectively secured to each other by way of the retainer when the retainer is in the first position, and further wherein the top portion can pivot about the pivot away from the base portion when the retainer is in the second position. If desired, the hinge can include a hinge pin attached to the top portion, wherein the pin is rotatably received in an opening in the base portion. By way of further example, the hinge can include a hinge pin attached to the base portion, wherein the pin is rotatably received in an opening in the top portion. If desired, the hinge can be located proximate a bottom of the bracket and the retainer is located proximate a top of the bracket. Alternatively, the hinge can be located proximate a top of the bracket and the retainer can be located proximate a bottom of the bracket. In another embodiment, the base portion and top portion can be connected by a tongue and slot at a first location, wherein the base portion and top portion can be selectively coupled to each other by the retainer at a second location, and the top portion can be fully removed from the base portion when the retainer is in the second position.

In accordance with further aspects of the disclosure, the base portion can include a bottom and at least one side extending substantially orthogonally with respect to the bottom, and the at least one side can have an opening defined therein for receiving the retainer. In some embodiments, the base portion includes two opposing parallel sides rising substantially orthogonally with respect to the bottom, wherein the at least one opening includes parallel elongate grooves defined in the opposing parallel sides. Preferably, the grooves are not parallel to the bottom of the base portion. In one embodiment, the grooves are substantially perpendicular to the bottom of the base portion. If desired, the grooves can be curved. If desired, the grooves can be disposed at an acute angle with respect to the bottom of the base portion. In one embodiment, the base portion further includes a back portion connected to the parallel sides and the base portion. In accordance with a further aspect, the retainer can be a floating pin that can freely slide along the grooves. In another embodiment, the retainer can be a displaceable slide.

In accordance with further aspects, the base portion can be adapted and configured to be mounted to a stair tread and the bracket can be adapted and configured to hold a carpet rod. In another embodiment, the base portion can be adapted and configured to be mounted to a wall or molding and the bracket is adapted and configured to hold a curtain rod. In any embodiment, the rod bracket can further define a finial receiving portion.

The disclosure also provides methods of mounting a rod. One exemplary method includes disposing a base portion of a rod bracket on a surface, the rod bracket further including a top portion adapted and configured to mate with the base portion, wherein the top portion and base portion cooperate to define a recess for holding at least a portion of a rod. The exemplary method further includes disposing a rod in the recess, and engaging a retainer to hold the top portion and the base portion together, wherein the retainer is slidably displaceable from a first position wherein the retainer prevents the base portion and top portion from separating, to a second position wherein the base portion and top portion can be separated.

It is to be understood that the foregoing general description and the following detailed description are exemplary and are intended to provide further explanation of the disclosed embodiments.

The accompanying drawings, which are incorporated in and constitute part of this specification, are included to illustrate and provide a further understanding of the method and system of the disclosed embodiments. Together with the description, the drawings serve to explain principles of the disclosed embodiments.

DETAILED DESCRIPTION OF PREFERRED EMBODIMENTS

Reference will now be made in detail to the present preferred embodiments of the disclosure, examples of which are illustrated in the accompanying drawings. The method and corresponding steps of the disclosed embodiments will be described in conjunction with the detailed description of the system.

The devices and methods presented herein may be used for mounting and retaining rods. The disclosed embodiments are particularly suited for holding carpet rods in place on staircases, and can also be used to hold other rods in place, such as curtain rods and the like.

Thus, in accordance with the disclosure, a rod bracket is provided including a base portion, a top portion, and a retainer for holding the top portion and base portion together.

Figure 1:
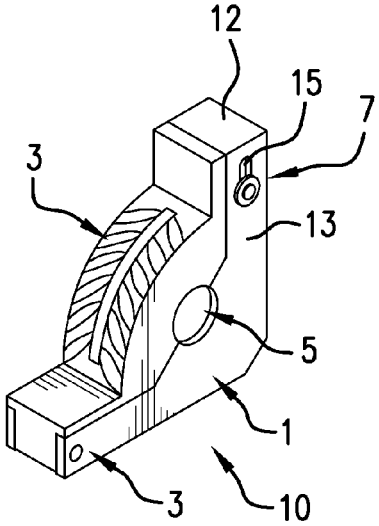
FIG. 1 is an isometric view of a first representative embodiment of a rod bracket in accordance with the disclosed embodiments in a closed condition.

For purpose of explanation and illustration, and not limitation, a view of a first exemplary embodiment of a rod bracket is shown in FIG. 1 and is designated generally by reference character 10. Other embodiments of a rod bracket in accordance with the disclosure, or aspects thereof, are provided in FIGS. 2-4, as will be described.

Figure 2:
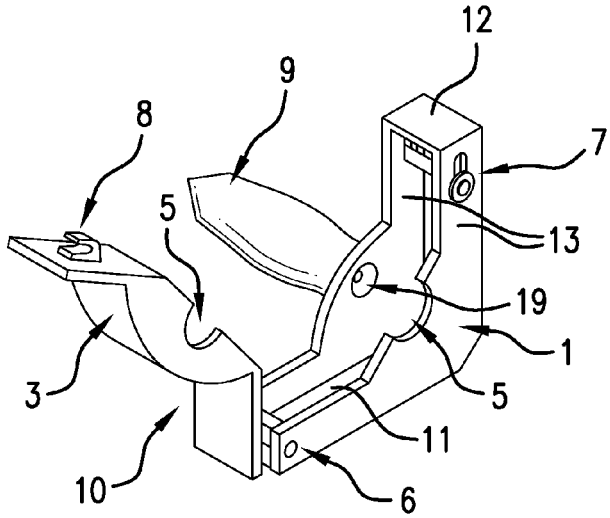
FIG. 2 is an isometric view of the embodiment of FIG. 1 in an open condition.

As illustrated in FIGS. 1-2, rod bracket 10 includes a base portion 1 adapted and configured to be mounted to a surface and a top portion, or cover, 3, that is adapted and configured to mate with the base portion 1. The top portion and base portion cooperate to define a recess 5, such as an access hole, for holding at least a portion of a rod. The rod can be any diameter, but is preferably adapted to accommodate rods that are about ½, ⅝ or ¾ of an inch in diameter. The bracket 10 further includes a retainer 7 adapted and configured to hold the top portion and the base portion together. As illustrated, the retainer 7 is slidably displaceable, from a first bottom position wherein the retainer 7 mates with a receptacle such as a hook 8 on the top portion 3 to prevent the base portion and top portion from separating, to a second, upper, position wherein the base portion 1 and top portion 3 can be separated.

In accordance with the illustrated embodiment of FIGS. 1-4, the retainer 7 is adapted and configured to fall into the first position under the action of gravity when the rod bracket 10 is mounted to a surface. This is advantageous because it prevents a user from neglecting to secure the top portion 3 in place by tightening a separate fastener. As illustrated, the base portion 1 and top portion 3 are connected by a hinge 6. Thus, the base portion and top portion can be selectively secured to each other by way of the retainer 7 when the retainer is in the lower first position as illustrated in FIG. 1. When the retainer is lifted out of engagement with hook 17, the top portion 3 can rotate about the hinge 6 away from the base portion when the retainer is in the second position as illustrated in FIG. 2. While a hinge pin is illustrated as forming the basis of the hinge, other structures can be used such as a living hinge and the like. As illustrated, the hinge 6 can include a hinge pin attached to the top portion 3, wherein the pin is rotatably received in an opening such as a recess or hole defined in the base portion 1. In an alternative embodiment, the hinge can include a hinge pin attached to the base portion, wherein the pin is rotatably received in a recess or opening in the top portion. Thus, as illustrated, the hinge 6 can be located proximate a bottom 11 of the bracket and the retainer 7 can be located proximate a top 12 of the bracket. Alternatively, the hinge 7 can be located proximate the top 12 of the bracket and the retainer 7 can be located proximate the bottom 11 of the bracket 10.

As is further illustrated in FIGS. 1-4, the base portion 1 includes a bottom 11 and at least one side 13 extending substantially orthogonally with respect to the bottom 11, and the at least one side 13 can have an opening 15 defined therein for receiving the retainer. In the illustrated embodiment, the base portion 11 includes two opposing parallel sides 13 rising substantially orthogonally with respect to the bottom, wherein the sides 13 include parallel elongate grooves 15 defined in the opposing parallel sides. Preferably, the grooves 15 are not parallel to the bottom of the base portion. In the illustrated embodiment, the grooves 15 are substantially perpendicular to the bottom 11 of the base portion 1. If desired, the grooves 15 can be curved. Moreover, the grooves 15 can be disposed at an acute angle with respect to the bottom of the base portion. As further illustrated, the base portion 1 further includes a back portion 14 connected to the parallel sides 13 and the bottom 11 of the base portion 1. While the retainer 7 can be a floating pin in a slot that can freely slide along the grooves having enlarged end portions (as depicted), other types of retainers can be used, such as a displaceable slide switch or the like. Most preferably, the retainer is adapted to default to engage under gravity to enhance safety. By way of further example, while the illustrated pin of retainer 7 can be provided with a round cross-section, other cross sectional shapes can be used, such as rectangular, rhomboidal, and the like, as desired.

In one application, the bracket 10 can be adapted and configured to be mounted to a stair tread such that the bracket 10 is used to hold a carpet rod. In another embodiment, the base portion 1 can be adapted and configured to be mounted to a wall, molding or the like and the bracket 10 can be adapted and configured to hold a curtain rod. In any embodiment, the rod bracket can further define a finial receiving portion 19 for receiving a finial 9.

Figure 3:
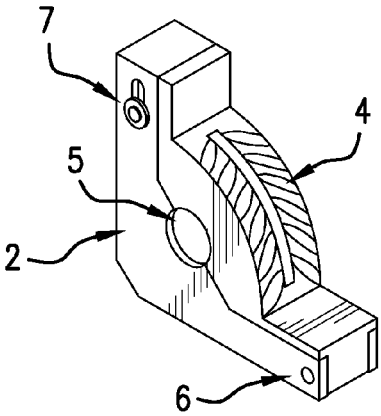
FIG. 3 is an isometric view of a second representative embodiment of a rod bracket in accordance with the disclosed embodiments in a closed condition.
Figure 4:
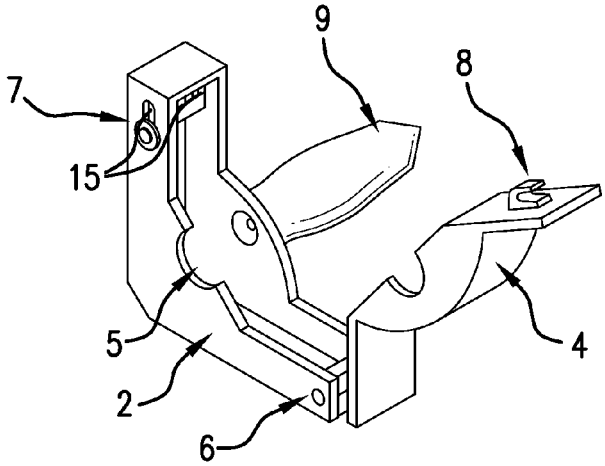
FIG. 4 is an isometric view of the embodiment of FIG. 3 in an open condition.
Figure 5:
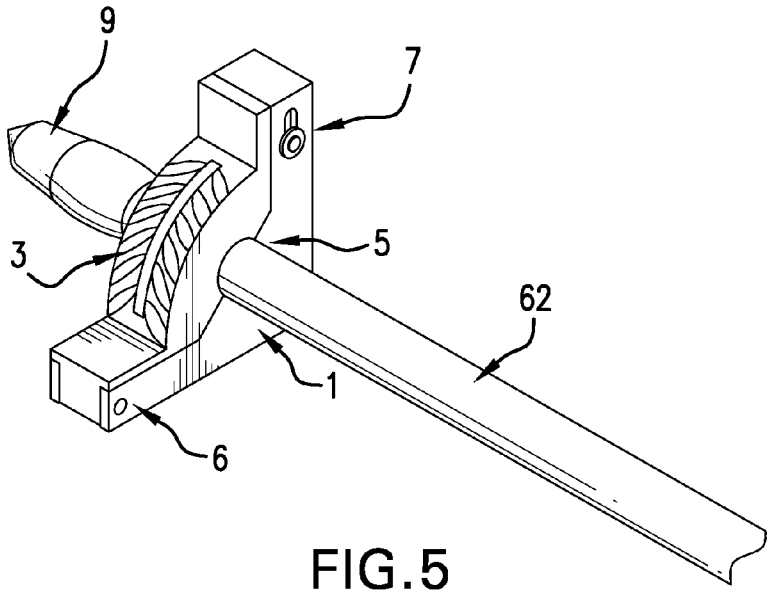
FIGS. 5-6 are schematic views of an exemplary system in accordance with the disclosed embodiments using a third embodiment of a rod bracket in accordance with the disclosed embodiments.
Figure 6:
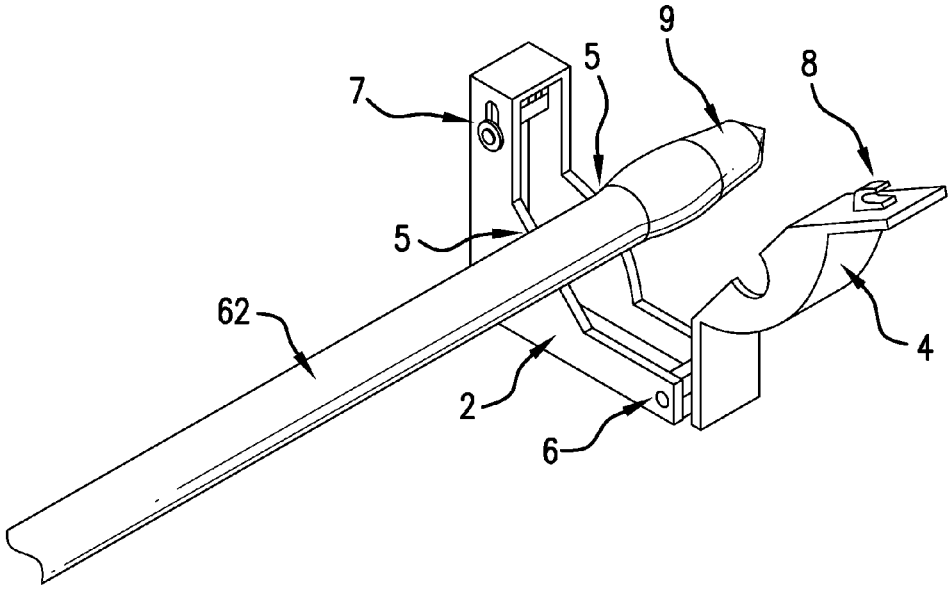

FIGS. 3-4 illustrate a second embodiment of a rod bracket in accordance with the disclosure. A main difference between this and the earlier embodiment is that the second embodiment reverses the arrangement of the opening 5 and the finial receiving portion 19 for receiving the finial 9. In FIGS. 3-4, 2 refers to the base portion, which transposes the locations of the finial receiving portion 19 and the opening 5 or other recess for holding the rod in place. As will be appreciated, the surface 4 of the top portion 3 can be provided with one or more decorative patterns, or can be provided without such a pattern. FIGS. 5-6 illustrate a third embodiment of a rod bracket in accordance with the disclosure. A main difference between this and the earlier embodiments is that the third embodiment includes a hole on both sides of the bracket to permit a rod 62 to fully pass through the bracket. If desired, finials can be placed at the ends of the rod 62.

Figure 7:
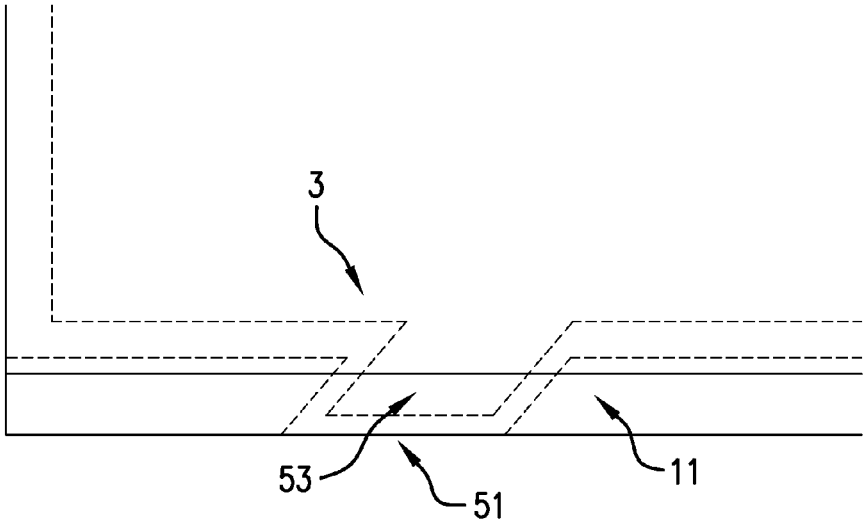
FIG. 7 is a schematic view of a portion of a fourth embodiment of a rod bracket in accordance with the disclosed embodiments.

In another embodiment, as illustrated in FIG. 7, the base portion 1 and top portion 3 can be connected by a key 53 and slot 51 formed into the bottom 11 of the base portion 1. The base portion 1 and top portion 3 can be selectively coupled to each other by the retainer 7, and the top portion 1 can be fully removed from the base portion 3 when the retainer 7 is in an unlocked position by removing the key 53 from the slot 51. For example, a protruding key 53 having a round, oval, or rectangular cross sectional shape can be located beneath and extend from the bottom of the block that would otherwise include the hinge pin as illustrated in FIG. 5. The key 53 can extend directly down vertically into the bottom 11 of the base portion, or can be angled away from the back of the base portion as depicted, such that a force applied on the rod (e.g., by a stair runner) would urge the key 53 and the edge of the opening 51 more tightly together.

The rod brackets disclosed herein can be made from a variety of materials such as plastics and/or metals. Preferably, the bracket 10 is made from a metallic material when used as a stair rod for strength purposes, such as brass, stainless steel or aluminum, or a base metal such as steel having a brass or other corrosion limiting top layer, such as an electroplated layer of metal, or brass, as desired. Bracket 10 can be made from other materials, and is preferably made mainly from plastic and/or wood products if used to hold a curtain rod in place.

Figure 8:
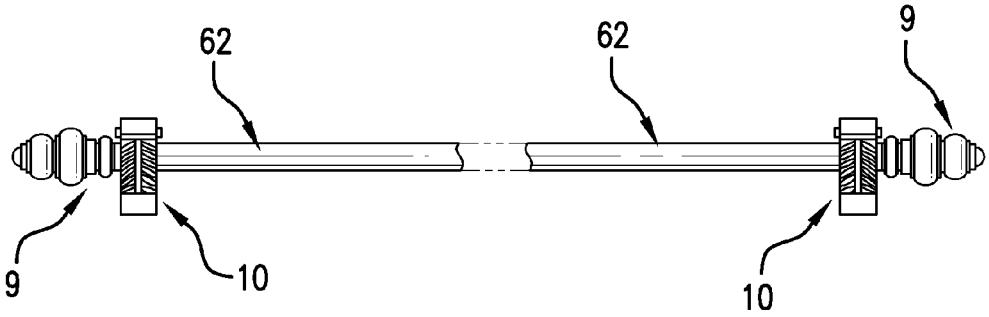
FIG. 8 is a schematic view of an exemplary system in accordance with the disclosed embodiments.

The disclosure also provides methods of mounting a rod using rod brackets as described herein. One exemplary method includes disposing a base portion (e.g., 1, 2) of a rod bracket on a surface (e.g., a stair tread, riser or curtain rod mounting location). The exemplary method further includes disposing a rod in the recess (e.g., 5) of the bracket (e.g., 10), and engaging a retainer to hold the top portion and the base portion together, wherein the retainer is slidably displaceable from a first position wherein the retainer prevents the base portion and top portion from separating, to a second position wherein the base portion and top portion can be separated. As illustrated in FIG. 8, the disclosure also provides a system including a pair of rod brackets 10 as disclosed herein, a rod 62 to span between and be held in place by the brackets, and finials 9 and mounting hardware, as desired.

The methods and systems of the disclosed embodiments, as described above and shown in the drawings, provide for rod brackets and related methods and systems with superior attributes including improved safety and ease of use. It will be apparent to those skilled in the art that various modifications and variations can be made in the device and method of the disclosed embodiments without departing from the spirit or scope of the disclosure. Thus, it is intended that the disclosed embodiments include modifications and variations that are within the scope of the appended claims and their equivalents.

What is claimed is:

1. A stair rod bracket, comprising:

a) a base portion;

b) a top portion pivotally connected to the base portion, wherein the top portion and base portion cooperate to define a recess for holding at least a portion of an end portion of a stair rod when the base portion and top portion are rotated toward each other to a closed condition to surround the stair rod; and c) a retainer adapted and configured to hold the top portion and the base portion together when the brackets are in the closed condition surrounding the stair rod, wherein the retainer includes a pin slidably displaceable along a plurality of opposing generally vertically oriented grooves in opposing wall portions of the base portion of the bracket from a first position wherein the retainer prevents the base portion and top portion from separating by virtue of the pin engaging with a hook mounted on the top portion of the bracket, to a second position wherein the base portion and top portion can be separated and pivoted away from each other from the closed condition into an open condition, wherein the retainer is adapted and configured to fall into the first position under the action of gravity when the rod bracket is mounted to a surface.

2. A stair rod bracket system, comprising a pair of stair rod brackets according to claim 1, and a stair rod.

* * * * *